US011440174B2

(12) United States Patent
Trick et al.

(10) Patent No.: US 11,440,174 B2
(45) Date of Patent: Sep. 13, 2022

(54) HAND-HELD POWER TOOL

(71) Applicant: Robert Bosch GmbH, Stuttgart (DE)

(72) Inventors: Achim Trick, Filderstadt (DE); Elmar Feder, Leonberg (DE); Manfred Lutz, Filderstadt (DE); Peter Stierle, Pliezhausen (DE); Thomas Schomisch, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 306 days.

(21) Appl. No.: 16/420,588

(22) Filed: May 23, 2019

(65) Prior Publication Data

US 2019/0358802 A1 Nov. 28, 2019

(30) Foreign Application Priority Data

May 23, 2018 (DE) ..... 10 2018 208 048.8

(51) Int. Cl.
*B25F 5/02* (2006.01)
*B24B 23/02* (2006.01)

(52) U.S. Cl.
CPC ..... *B25F 5/02* (2013.01); *B24B 23/028* (2013.01)

(58) Field of Classification Search
CPC .... B25F 5/02; B25F 5/00; B25F 5/001; B24B 23/028
See application file for complete search history.

(56) References Cited

U.S. PATENT DOCUMENTS

| | | | | |
|---|---|---|---|---|
| 10,799,997 | B2 * | 10/2020 | Schadow | B23Q 17/24 |
| 2011/0188232 | A1 * | 8/2011 | Friedman | H02K 16/005 362/119 |
| 2014/0008088 | A1 * | 1/2014 | Chellew | B25F 5/021 362/559 |
| 2014/0284070 | A1 * | 9/2014 | Ng | B25F 5/00 173/2 |
| 2015/0209950 | A1 * | 7/2015 | Lutz | B25F 5/02 173/20 |
| 2017/0125192 | A1 * | 5/2017 | Hanai | H01H 9/20 |

FOREIGN PATENT DOCUMENTS

| | | | |
|---|---|---|---|
| DE | 10 2013 209 094 | A1 | 8/2014 |
| DE | 10 2015 226 088 | A1 | 6/2017 |
| DE | 10 2016 206 050 | A1 | 10/2017 |
| DE | 20 2016 105 458 | U1 | 2/2018 |
| DE | 10 2016 218 535 | A1 | 3/2018 |
| WO | 2016096452 | A1 | 6/2016 |

* cited by examiner

*Primary Examiner* — Anna K Kinsaul
*Assistant Examiner* — Veronica Martin
(74) *Attorney, Agent, or Firm* — Maginot, Moore & Beck LLP

(57) ABSTRACT

A hand-held power tool, in particular an angle grinder, includes a drive unit, a machine housing, and a user interface unit. The machine housing surrounds the drive unit. The drive unit is configured to transmit a motion to an output unit. The user interface unit is configured to operate the hand-held power tool, and is either (i) positioned on an inner element of the hand-held power tool, in particular a flat outer surface of the inner element, or (ii) connected to the inner element, in particular the flat outer surface of the inner element.

16 Claims, 6 Drawing Sheets

HAND-HELD POWER TOOL

This application claims priority under 35 U.S.C. § 119 to patent application no. DE 10 2018 208 048.8, filed on May 23, 2019 in Germany, the disclosure of which is incorporated herein by reference in its entirety.

The disclosure relates to a hand-held power tool.

BACKGROUND

Disclosed in WO 2016/096452 is an optical indicating device unit for use in an external application unit, having at least one first housing, which has at least one illumination device and/or at least one optical indicating device. The illumination device and/or the optical indicating device are designed to indicate information visually. The optical indicating device unit has a mechanical interface for connecting the first housing to a second housing, and has a data interface, which transmits information to the illumination device and/or to the optical indicating device.

SUMMARY

The disclosure is based on the object of improving a hand-held power tool by simple design measures.

The object is achieved with a hand-held power tool, having a drive unit, surrounded by a machine housing, for transmitting a motion to an output unit, and having a user interface unit that is designed to operate the hand-held power tool. According to the disclosure, the user interface unit is arranged on an inner element, in particular a flat outer surface, of the hand-held power tool, or is connected to the inner element, in particular a flat outer surface.

By means of the hand-held power tool according to the disclosure, assembly of the hand-held power tool can be simplified particularly easily in that, for example, the user interface unit is arranged on the inner element of the hand-held power tool. This inner element in this case may be augmented by, or connected to, any further internal components, in order for the inner element to be inserted, together with the further internal components, for example in one piece, into the machine housing. This consequently dispenses with any particularly intricate fine work, in which the internal components are connected to a machine housing that is connected to, or inserted with, the inner element. In particular, this consequently dispenses with faulty or incorrect connections between the internal components. By means of the hand-held power tool according to the disclosure, the inner elements can be connected, for example, to any internal components, in order ultimately for these connected components to be inserted in one piece into the machine housing, or connected to it.

The hand-held power tool may be realized as an angle grinder. It is understood that the hand-held power tool may also be realized as another hand-held power tool, considered appropriate by persons skilled in the art, such as, for example, as a drill/driver, a hammer drill, a palm router, or the like. The hand-held power tool may be realized as a hand-held, portable hand-held power tool that is intended to be held by an operator's hand. The hand-held power tool is intended not to exceed a weight of, preferably, 40 kg.

A "drive unit" in this context is to be understood to mean, in particular, a unit designed to generate at least one drive moment and to make it available to be transmitted on to an output unit, in particular to an insert tool. Advantageously, the hand-held power tool comprises the drive unit. Particularly advantageously, the drive unit has at least one electric motor. The drive unit may have a drive shaft. The drive unit may be realized as an electronically commuted motor or as a brush-commuted motor. The output unit may have a receiver for receiving a tool, in particular an insert tool, that is designed to transmit a work motion to a workpiece on which work is to be performed. The drive unit in this case may transmit, for example, a rotational motion to a translational and/or rotational motion of the tool, in particular of the insert tool.

A "user interface unit" is to be understood to be a unit designed to enable an interaction between the hand-held power tool and an operator of the hand-held power tool, in particular in order to transfer an input, in particular by means of an operating unit, from an operator to a hand-held power tool, and/or to output a state or a setting, in particular by means of an indicating unit or an information unit, of the hand-held power tool to the operator. By means of the user interface unit, an operator can, on the one hand, control the hand-held power tool by open-loop or closed-loop control, and on the other hand the hand-held power tool can transfer a feedback to the operator of the hand-held power tool.

The user interface unit may have a user interface element. The user interface element may be realized as an operating element. An "operating element" is to be understood here to mean, in particular, an element having at least one component that can be actuated directly by an operator, and that is designed to influence and/or change a process and/or a state of a unit coupled to the operating element, as a result of an actuation and/or as a result of an input of parameters. In particular, the operating element is to be designed to receive an input quantity from an operator in an operating procedure, and in particular to be contacted directly by an operator, with touching of the operating element being sensed, and/or an actuating force exerted upon the operating element being sensed, and/or being forwarded on mechanically for the purpose of actuating a unit.

The operating element may be realized as an operating button.

The user interface element may be realized as an indicating element. An "indicating element" is to be understood to mean, in particular, an element that has at least two indication states and that, in at least one indication state, conveys an optical and/or acoustic indication, and preferably emits a signal that is visible to and/or audible by a person. An "optical indicating means" is to be understood to mean, in particular, a lamp, preferably an LED, and/or a, preferably back-lit, display unit, in particular a matrix display unit, preferably an LCD display, an OLED display and/or electronic paper (e-paper, e-ink). An "acoustic indicating means" is to be understood to mean, in particular, a unit designed to convert electrical energy into sound energy. In particular, it has a set of electronics designed to generate a frequency of between 0 Hz and 20 kHz, in particular between 50 Hz and 8 kHz, preferably between 200 Hz and 5 kHz, and to transmit this to a tone generator of the acoustic indicating element, in particular to a string and/or a membrane, preferably to a loudspeaker. In particular, the indicating element is to be designed, at least partly, preferably at least almost entirely, to draw the attention of a user to at least one aspect, in particular to at least one parameter, of the tool unit, and/or to provide a user with relevant information, in particular for use of the tool unit.

In particular, the operating element and the indicating element may be realized as one piece. In this case, the operating element and the indicating element may be realized as a touch-sensitive operating element. A "touch-sensitive" operating element it to be understood to mean, in particular, an operating element designed to react to a touch and/or an approach by an operator, in particular an approach of a body part, for example a finger, of an operator, in particular within a distance of maximally 10 cm, in particular maximally 3 cm, advantageously maximally 1 cm, preferably maximally 0.5 cm. Preferably, the operating element reacts to an approach independently of a direct touch and/or exertion of pressure, in particular through a touch surface. In particular, the touch surface is realized as a glass and/or plastic unit and/or as a hob panel. For example, such a touch-sensitive operating element may be realized as a sensor screen, or as a touchscreen.

The user interface unit may have a touch-sensitive screen that is designed to operate the user interface unit by means of a touch on the screen. The screen may indicate information. The user interface unit may thus have an operating element and an indicating element.

An inner element is to be understood to mean an element that, in an installed state, is surrounded by the machine housing and that is preferably arranged in an interior surrounded by the machine housing. The inner element is preferably realized as an inner component. The inner element may have an outer surface that delimits the inner element. The outer surface may be flat. Alternatively, the outer surface may be curved. The outer surface may be designed to form a fixed or separable connection to the user interface unit. The outer surface may have an adhesion element that is designed to hold the user interface unit to the inner element, in particular to the outer surface of the inner element, by adhesion. The inner element may have an inner recess. The inner recess may be delimited by the outer surface. The inner recess may be designed to receive the user interface unit.

The claims specify further expedient developments of the hand-held power tool according to the disclosure.

It may be expedient for the inner element to be realized as a motor housing of the drive unit or as an air guide element. The inner element may be realized as an end shield of the drive unit. The inner element may delimit the drive unit. The inner element may surround the drive unit in at least one 360° plane. The inner element may be formed from a metal or a plastic. The inner element may be surrounded by the machine housing. The inner element may be surrounded by a machine housing part realized as a transmission housing. The inner element may be surrounded by a machine housing part realized as a handle housing. The inner element may be realized as an air guide element that is designed to guide an airflow, in particular a cooling airflow, through the machine housing of the hand-held power tool. The air guide element may be substantially annular. The air guide element may surround the drive unit, in particular a drive shaft of the drive unit. The drive unit, in particular the drive shaft of the drive unit, may extend through an annular region of the air guide element. The user interface unit may be arranged on a side of the air guide element that faces away from the airflow. The user interface unit can thereby additionally be cooled.

The air guide element may have a support element that is designed to hold a, in particular electric, line for, in particular electrically, connecting the user interface element to the electronics unit and/or to the drive unit. The support element may extend along a longitudinal extent of the hand-held power tool. The support element may be realized as a support bar. The support bar may clamp the electric lean by means of a clamping means, in particular in order to bundle the electric line along the support element. Assembly of the hand-held power tool can thereby be facilitated is a particularly simple manner. Alternatively or additionally, the electric line may be realized as a data line that is designed to transmit data from or to the user interface unit. An optical line, or other line considered appropriate by persons skilled in the art, may also be realized as a data line.

Further, it may be expedient for the user interface unit to be surrounded by the machine housing, in particular in a 360° plane. The plane may extend substantially parallel to a longitudinal extent of the hand-held power tool. The user interface unit may be delimited, respectively, by a machine housing part realized as a transmission housing and by a machine housing part realized as a handle housing. The user interface unit can thereby be secured, particularly advantageously, against movement.

It may additionally be expedient for the user interface unit to be overlapped by the machine housing, in particular on a side that faces away from the inner element. In particular, a peripheral region of the user interface unit may be overlapped by the machine housing. Preferably, a peripheral region of the user interface unit may be arranged on both sides, in a direction orthogonal to a longitudinal extent of the hand-held power tool. The user interface unit may be overlapped by the machine housing on a side that faces away from the inner element and a side that faces toward the inner element, and form corresponding overlaps. The overlaps may form a guide recess that is designed to receive the user interface unit. The assembling of the hand-held power tool can thereby be facilitated in a particularly advantageous manner. Moreover, by means of the overlap, the user interface unit can be prevented, in a particularly simple manner, from being held in the machine housing.

Furthermore, it may be expedient for the user interface unit to be connected to the inner element in a materially bonded manner, in particular by adhesive bonding, by positive engagement, in particular by clamping, or by non-positive engagement, in particular by tensioning. This makes it possible to produce, in a particularly simple manner, a connection of the user interface unit to the inner element that also enables the user interface unit to be positioned with precision during the assembly operation.

It is proposed that the user interface unit have two user interface elements, a first user interface element being realized as a HMI for actuating or indicating a function of the hand-held power tool, and a second user interface element being realized as an actuating element for actuating the drive unit, in particular an On/Off switch. The user interface unit may be connected, by means of electric lines, to the electronics unit and/or to a battery interface for receiving a battery. The first user interface element and the second user interface element may be connected to each other by means of electric lines, and in particular transmit data or switching states. A HMI in this context is to be understood to mean a Human-Machine Interface that constitutes a user interface between a person, in particular the operator of the hand-held power tool, and a machine, in particular a hand-held power tool.

It is understood that, as an alternative or in addition to the electric lines, other lines, considered appropriate by persons skilled in the art, are a possibility for data transmission, such as, for example, optical lines.

It is further proposed that the machine housing is formed from a shell construction, and has a machine-housing shell. The machine housing may have a first half-shell and a second half-shell that form at least one machine-housing part, in particular the handle housing. The half-shells may be formed from a plastic. Assembling of the hand-held power tool can the thereby be facilitated in a particularly simple manner.

It is further proposed that the machine housing be formed from a barrel construction, and have a machine-housing barrel. In particular, the machine-housing barrel may have a handle region. The machine-housing barrel may be realized as a hollow cylinder.

It is additionally proposed that the machine housing have a delimitation recess for receiving the user interface unit. The delimitation recess may be realized as a through-opening that, at least in portions, goes fully through a material thickness of the machine housing. The delimitation recess may be delimited by a transmission housing. The delimitation recess may be delimited by the handle housing. The user interface unit can thereby be integrated into the machine housing in a particularly simple manner.

It may be expedient for the delimitation recess to be delimited by the inner element, in particular the outer surface of the inner element. It is thereby possible to define a position at which the delimitation recess is to be arranged in order to ensure ease of assembling.

It may additionally be expedient for the hand-held power tool to have a sealing element that is arranged between the user interface unit and the machine housing. The sealing element may be realized as a gap-type seal, in particular as a labyrinth seal. The sealing element may be formed from a plastic. The sealing element may be formed from a foam material. The sealing element may be designed to seal off a gap between the machine housing and the user interface unit, for example against dirt and water.

A "sealing element" in this context is to be understood to mean an element or a structure that prevents, or at least limits, unwanted transfers of substances, in particular from a first volume into a second volume.

BRIEF DESCRIPTION OF THE DRAWINGS

Further advantages become evident from the following description of the drawing. In the drawing, exemplary embodiments of the disclosure are represented. The drawings, the description and the claims contain numerous features in combination. Persons skilled in the art with expediently also consider the features singly, and combine them to form appropriate further combinations. There are shown therein:

DETAILED DESCRIPTION

In the following description with regard to the figures, parts that are the same are denoted by the same references.

The figures each relate to a cutting disk for cutting and/or grinding workpieces. The cutting disk according to the disclosure has a universal application and is suitable, in particular, for performing work on workpieces made of cellulose, such as, for example, grass, brushwood or roots, wood, plastic or a composite. Alternatively, however, the cutting disk may also be suitable for performing work on, for example, metal, rock or a composite.

The cutting disk is designed to be received in a separable manner on standard commercial hand-held power tools that are driven in rotation. The cutting disk may be received in a receiving device of the hand-held power tool, known to persons skilled in the art and designed to receive the cutting disk, having a rotational and/or translational motion on a workpiece upon which work is to be performed.

Figure 3A:
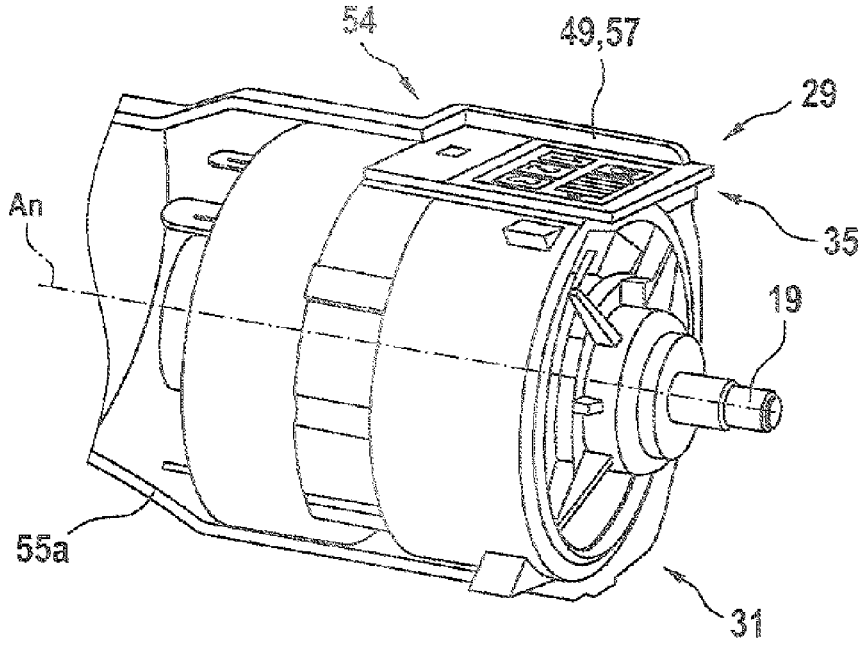
Figure 3B:
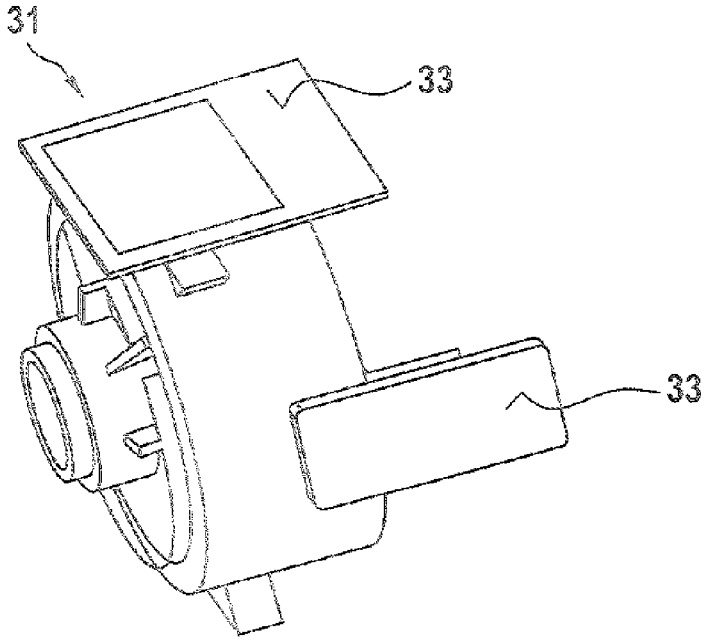
Figure 3C:
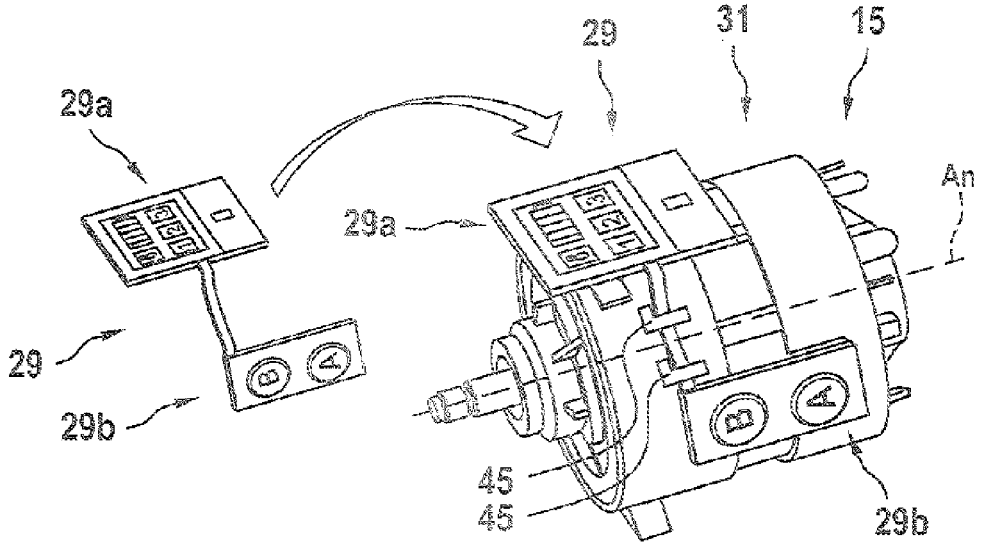

The disclosure is described using the example of a hand-held power tool 11 realized as an angle grinder. The held power tool 11 has a machine housing 13, which surrounds a drive unit 15, realized as an electric motor, for transmitting a motion to an output unit 17. The electric motor is preferably an EC motor. The drive unit 15 a drive shaft 19 (FIGS. 3*a*, 3*c*).

The held power tool 11 has an operating element 21 realized as an On/Off switch. The operating element 21 is realized as a slide switch, and is designed to switch the drive unit 15 on or off.

The held power tool 11 has a protective hood 23, which is arranged on the machine housing 13. The held power tool 11 has a grinding disk 25 that is surrounded by the protective hood 23. The held power tool 11 has an ancillary handle 27, which is arranged on the machine housing 13.

The held power tool 11 has a longitudinal extent, and extends substantially along a longitudinal axis L of the held power tool 11. The longitudinal axis L may realized so as to be parallel to a drive axis An of the drive unit 15. The output unit 17 has an output axis Ab that is arranged transversely, in particular substantially perpendicularly, in relation to the drive axis An. The output unit 17 projects at least partly from the machine housing 13, such that the output unit 17 can be coupled to a tool, in particular an insert tool 25. The output unit 17 has a receiver for receiving the tool 25, in particular the insert tool, that is designed to transmit a work motion onto a workpiece on which work is to be performed.

The held power tool 11 has a user interface unit 29, which is designed to operate the held power tool 11. The user interface unit 29 is arranged on a flat outer surface 33 of an inner element 31 of the held power tool 11, and preferably connected to the outer surface 33. The inner element 31, in an installed state, is surrounded by the machine housing 13. The inner element 31 is arranged in an interior surrounded by the machine housing 13. The inner element 31 is realized as an inner component. The outer surface 33 of the inner element 31 delimits the inner element 31. The outer surface 33 is flat. Alternatively, the outer surface 33 may be curved. The outer surface 33 may be designed to form a fixed or separable connection to the user interface unit 29. The outer surface 33 may have an adhesion element (not shown) that is designed to hold the user interface unit 29 on the outer surface 33 of the inner element 31 by adhesion, or bonding. The inner element 31 may have an inner recess (not shown). The inner recess may be delimited by the outer surface 33. The inner recess may be designed to receive the user interface unit 29. The user interface unit 29 may be connected to the outer surface 33 of the inner element 31 in a materially bonded manner, in particular by adhesive bonding, by positive engagement, in particular by clamping, or by non-positive engagement, in particular by tensioning.

The outer surface 33 of the inner element 31 and the machine housing 13 form a separation space 35 that is designed to receive the user interface unit 29, at least substantially, and in particular to hold it on the machine housing 13 by positive engagement.

Figure 5A:
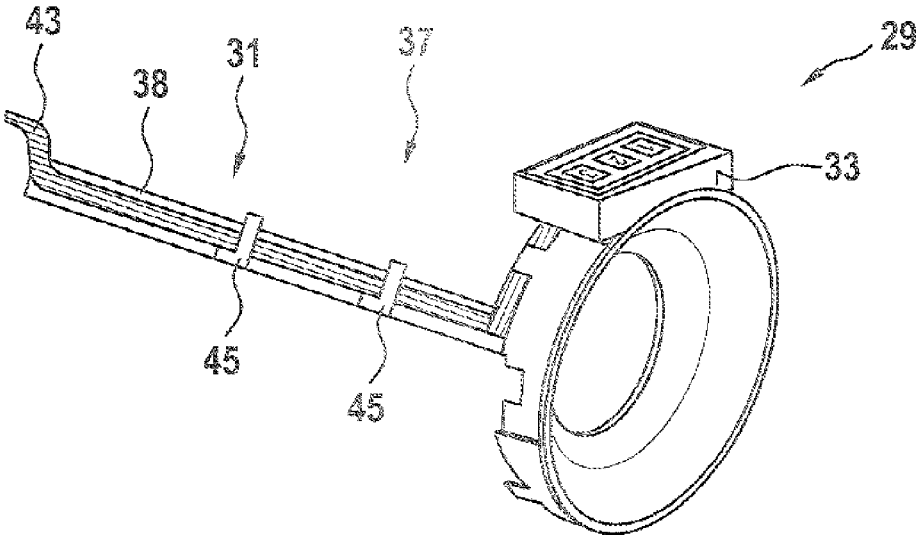

The inner element 31 is realized as a motor housing (FIG. 2) of the drive unit 15 or as an air guide element 37 (FIG. 5*a*).

Alternatively or additionally, the inner element 31 may be realized as another internal part such as, for example, an electronics unit, a switching unit, or the like.

Figure 2:
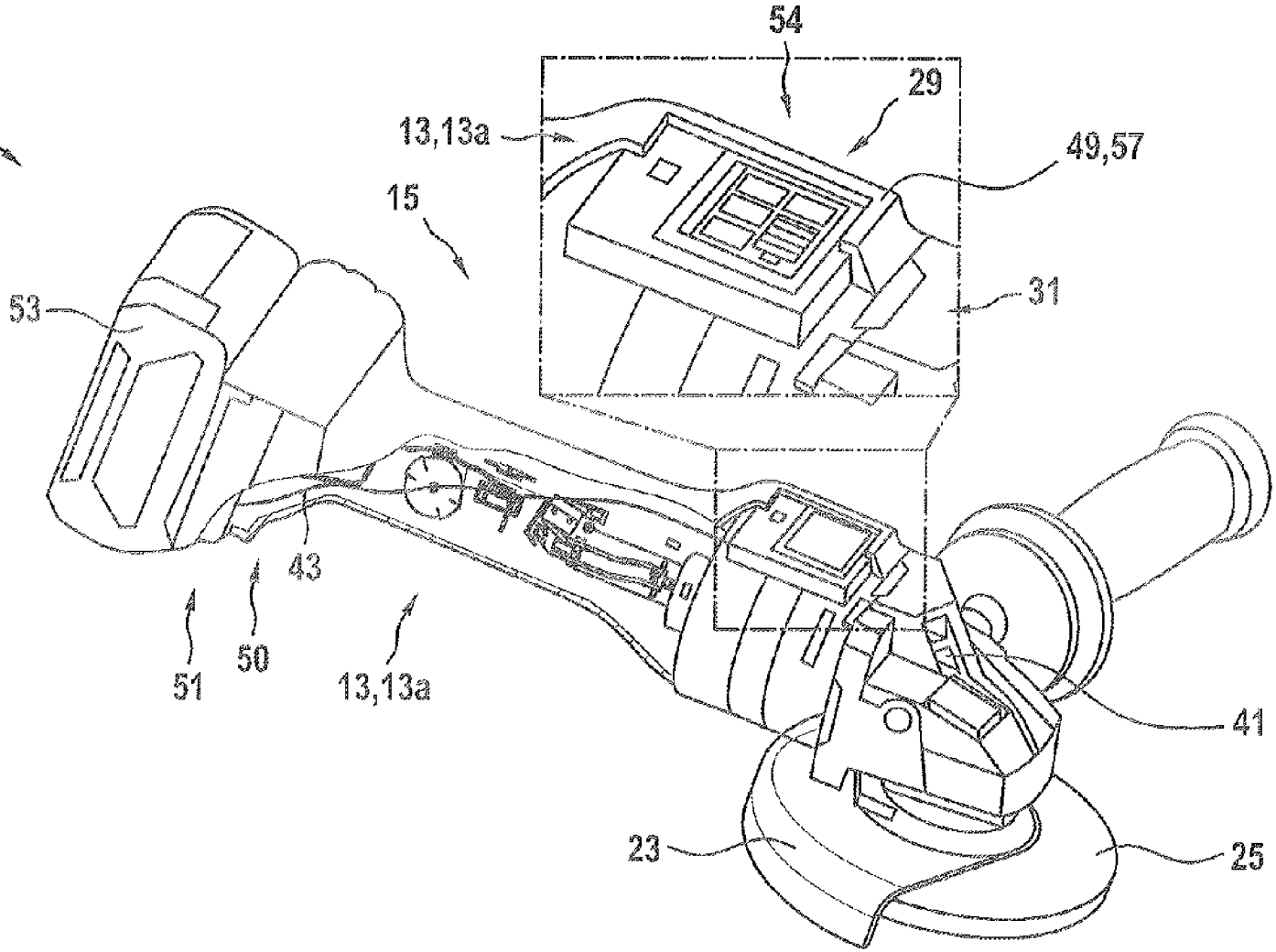

The inner element 31 is realized as a motor housing of the drive unit 15 (FIG. 2). The inner element 31 is realized as an end shield of the drive unit 15. The inner element 31 delimits the drive unit 15 in an axial direction of the drive unit 15. The inner element 31 surrounds the drive unit 15 in at least one 360° plane. The inner element 31 is formed from a metal. The inner element 31 is surrounded, at least substantially, by the machine housing 13. The inner element 31 is surrounded by a machine-housing part 13 realized as a handle housing 13*a*.

Figure 5B:
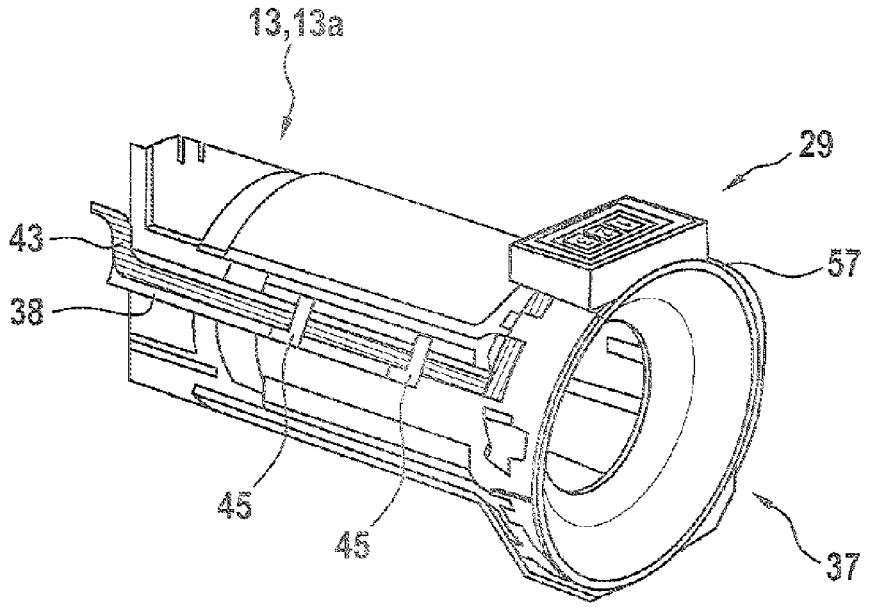
Figure 5C:
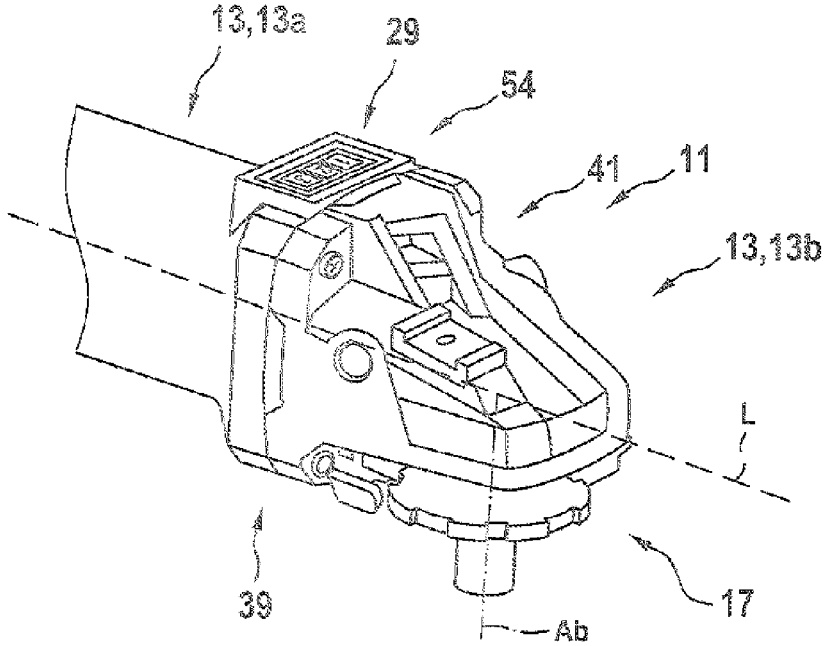

The inner element 31 is realized as an air guide element 37, which is designed to guide an airflow, in particular a cooling airflow, through the machine housing 13 of the held power tool 11 (FIG. 5*a*). The air guide element 37 is substantially annular. The air guide element 37 surrounds a drive shaft of the drive unit 15. The drive shaft of the drive unit 15 extends through an annular region of the air guide element 37. The user interface unit 29 is arranged on a side of the air guide element 37 that faces away from the airflow (not shown). The air guide element 37 may contact the transmission housing 13*b* (FIGS. 5*b*, 5*c*). The air guide element 37 may be part of a connection point 39 of the machine housing 13 realized as a handle housing 13*a*, in order to form a connection to the machine housing 13 realized as a transmission housing 13*b*. The air guide element 37 forms a flow connection, of the machine housing 13 realized as a handle housing 13*a*, to the machine housing 13 realized as a transmission housing 13*b*. The transmission housing 13*b* in this case has ventilation openings 41, which are designed to form an airflow out of the machine housing 13, into the machine housing 13.

The air guide element 37 has a support element 38, which is designed to hold an electric line 43 for electrically connecting the user interface element to an electronics unit 50 and/or to the drive unit 15. The support element extends along a longitudinal extent of the held power tool 11. The support element 38 is realized as a support bar. The support element 38 may extend from the annular region of the air guide element 37, along the longitudinal axis of the held power tool 11. The support element 38 has two clamping means 45 that are designed to clamp the electric line 43. The clamping means 45 may be designed to bundle or hold the electric line 43 along the support element 38. The electric lines 43 are realized as connection lines 43 that are designed to transmit signals or data from and/or to the user interface unit 29. Alternatively or additionally, the electric lines 43 may be realized as optical lines 43. However, other lines 43 considered appropriate by persons skilled in the art are also a possibility for data, signal and/or electric current transmission.

Figure 3D:
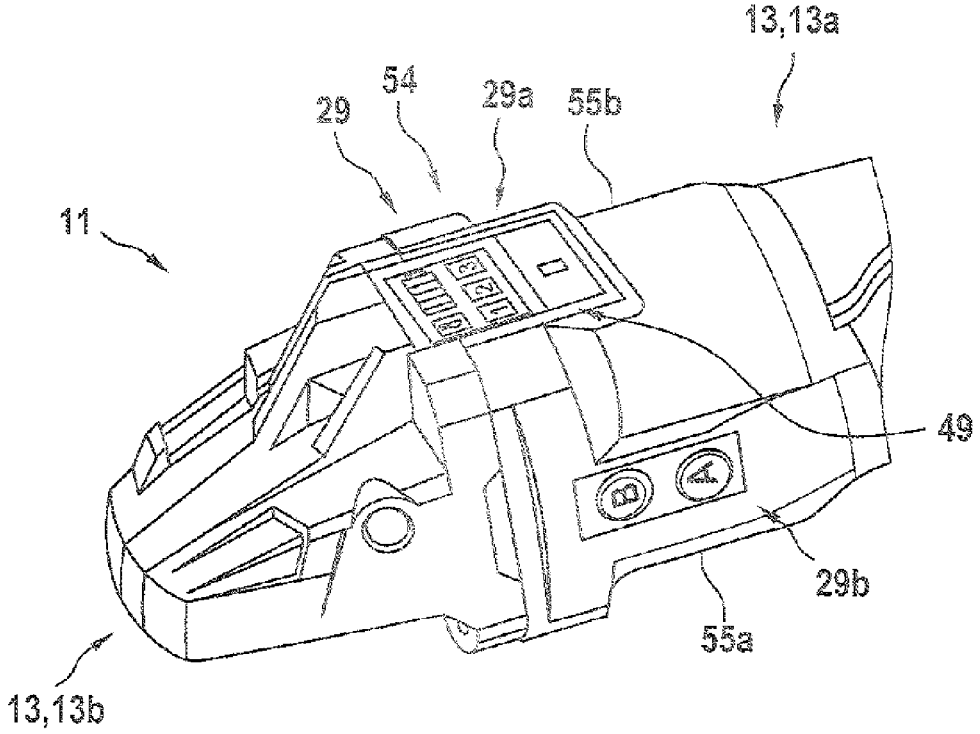

The user interface unit 29 is surrounded by the machine housing 13 in a 360° plane E. The plane E extends substantially parallel to the longitudinal extent of the held power tool 11. The user interface unit 29 is delimited by a machine-housing part 13 realized as a handle housing 13*a* (FIG. 2) or, respectively, by a machine-housing part 13 realized as a transmission housing 13*b*, and by a machine-housing part 13 realized as a handle housing 13*a* (FIGS. 3*d*, 5*c*).

The user interface unit 29 is overlapped by the machine housing 13 on a side that faces away from the inner element 31. The user interface unit 29 has a peripheral region, or edge region, that delimits the user interface unit 29 and that is overlapped, at least substantially, by the machine housing 13. An overlap 49 can thereby be realized. The peripheral region of the user interface unit 29 may be arranged on both sides, in a direction orthogonal to the longitudinal axis L of the held power tool 11. The user interface unit 29 may be overlapped by the machine housing 13 on a side that faces away from the inner element 31 and on a side that faces toward the inner element 31, and form corresponding overlaps. The overlaps may form a guide recess that is designed to receive the user interface unit 29.

The user interface unit 29 has two user interface units 29*a*, 29*b*, the first user interface unit 29*a* being realized as an operating element and as an indicating element. The first user interface unit 29*a* is designed to actuate and indicate a function of the held power tool.

The user interface unit 29 has two user interface elements 29*a*, 29*b*, a first user interface element 29*a* being realized as a HMI for actuating or indicating a function, or an item of information, of the held power tool 11, and a second user interface element 29*b* being realized as an actuating element for actuating the drive unit 15, in particular an On/Off switch (FIG. 3*c*). The second operating element 29*b* may be realized as a mechanical slide switch (FIG. 3*c*). The second operating element 29*b* may be realized as an electronic operating button (FIGS. 1, 2, 4, 5*a*). A function of the held power tool 11 may be understood to mean, for example, an operation of switching the drive unit off or on, limiting a drive power of the drive motor, limiting a rotational speed of the drive motor, limiting a duration of use of the held power tool 11, switching a state of the held power tool 11, etc. For example, the function may also be understood to include output of the temperature, of an overload circuit or of a battery status. Other functions, considered appropriate by persons skilled in the art, may also be possibilities. The user interface elements 29*a*, 29*b* are connected by means of electric lines. The electric lines are arranged, by means of clamping means, on the inner element 31 realized as a machine housing of the drive unit 15 (FIG. 3*d*).

The first and the second user interface element 29*a*, 29*b* are connected to the electronics unit 50 and/or to a battery interface 51 by means of lines 43. The battery interface 51 is designed to receive the battery 53 and to supply the held power tool 11 with electrical energy. The first user interface element 29*a* and the second user interface element 29*b* may be connected to each other by means of an electric line 43 and, in particular, transmit data or switching states.

The machine housing 13 has a delimitation recess 54 for receiving the user interface unit 29. The delimitation recess 54 is realized as a through-opening that, at least in portions, goes fully through a material thickness of the machine housing 13. The delimitation recess 54 is delimited by a transmission housing 13*b* (FIGS. 3*d*, 5*c*). The delimitation recess 54 is delimited by the handle housing 13*a* (FIGS. 1, 2, 4).

Figure 1:
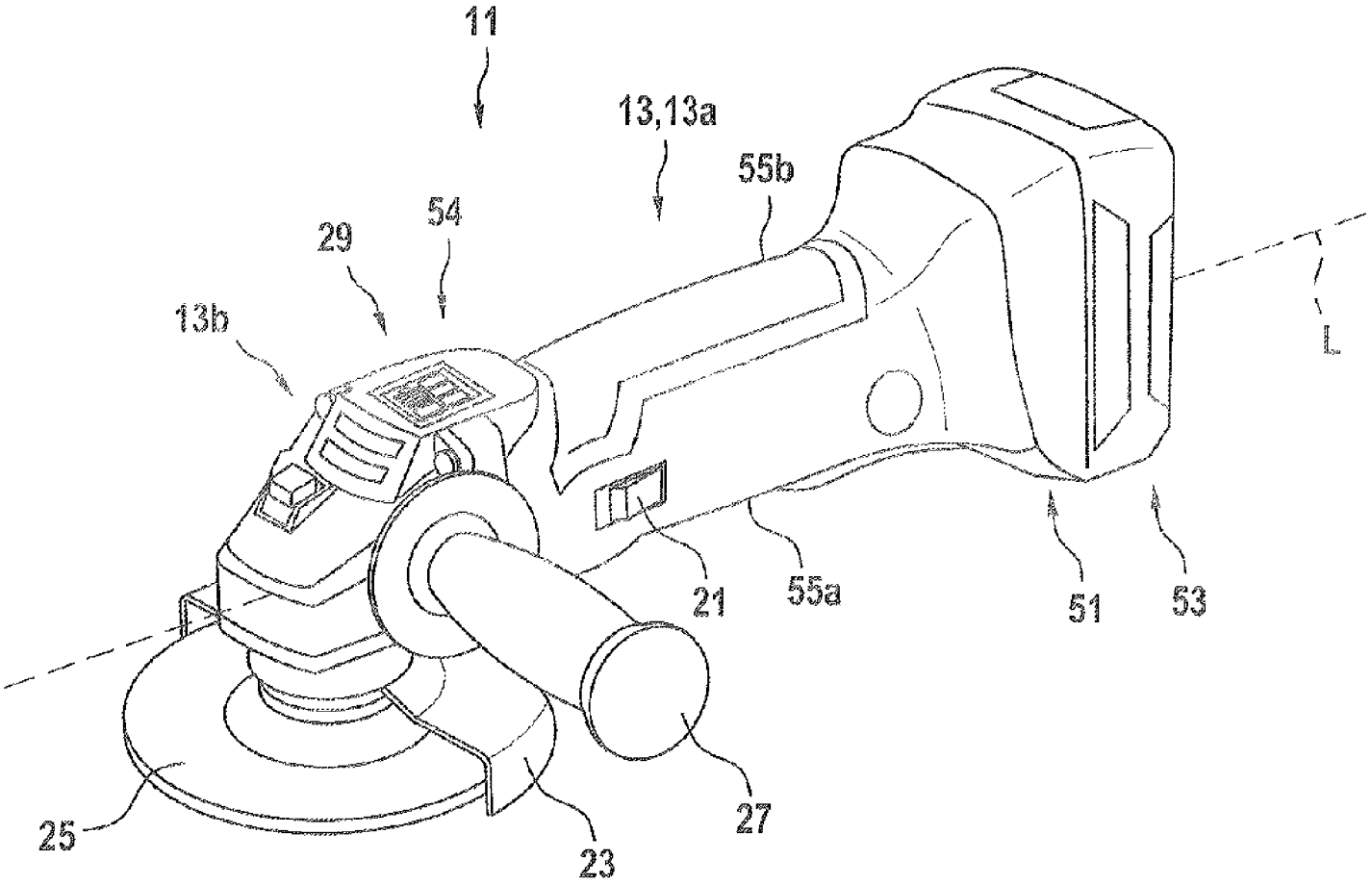
FIG. 1 a perspective view of a first embodiment of a hand-held power tool according to the disclosure, FIG. 2 a further view of the hand-held power tool from FIG. 1, FIG. 3*a* a portion of a further embodiment of a hand-held power tool, FIG. 3*b* an inner element of the portion of the hand-held power tool from FIG. 3*a*, FIG. 3*c* a further view of the portion of the hand-held power tool from FIG. 3*a*, FIG. 3*d* a perspective view of another portion of the hand-held power tool from FIG. 3*a*, FIG. 4 a cross section of a further portion of the hand-held power tool, FIG. 5*a* a perspective view of a further embodiment of yet another portion of the hand-held power tool, FIG. 5*b* a further view of the portion of the hand-held power tool from FIG. 5*a*, and FIG. 5*c* a perspective view of a further portion of the hand-held power tool from FIG. 5*a*.
Figure 4:
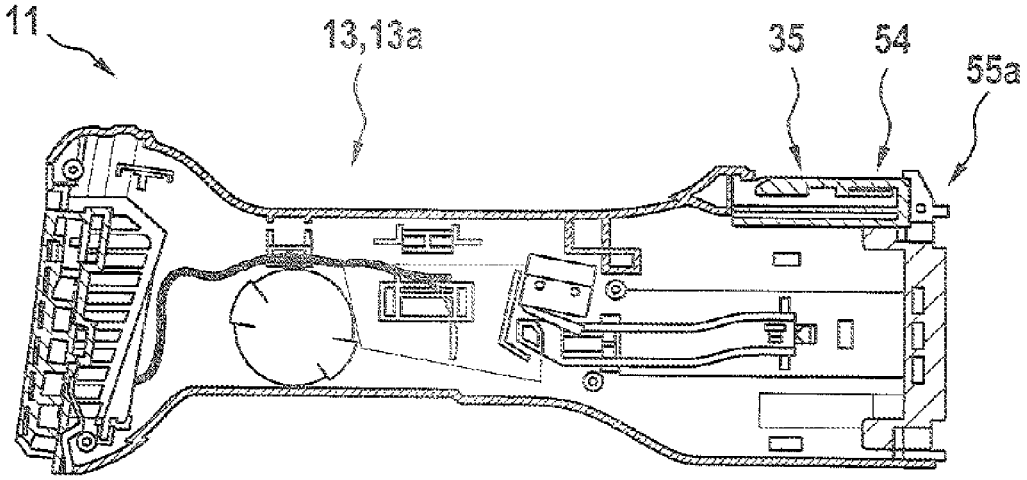

The machine housing 13 is formed from a shell construction, and has a machine-housing shell (FIGS. 1, 2, 4). The machine housing 13 has a first half-shell and a second half-shell 55*a*, 55*b*, which form at least the machine-housing part 13 realized as a handle housing 13*a*. The half-shells 55*a*, 55*b* are delimited by the delimitation recess 53. Both half-shells 55*a*, 55*b* have a delimitation recess 53. The half-shells 55*a*, 55*b* are formed from a plastic. For example, FIG. 4 shows a substantially empty half-shell 55*a*, into which an inner element 31, together with the user interface unit 29, can be inserted particularly easily in one piece, whereas, in the case of an inner element 31 already inserted in the half-shell 55*a*, assembly is rendered significantly more difficult by a user interface unit 29 that is to be inserted subsequently.

Alternatively, the machine housing 13 is formed from a barrel construction, and has a machine-housing barrel (FIG. 5*b*). The machine-housing barrel forms a handle housing. The machine housing 13 is formed from a hollow cylindrical machine housing 13 (FIGS. 3*d*, 5*b*) realized as a handle housing (FIGS. 5*b*, 5*c*). In each case, the machine-housing part 13, realized as a handle housing 13*a*, and as a transmission housing 13*b*, is delimited along the longitudinal axis L of the held power tool 11 by the delimitation recess 54.

The delimitation recess 54 is delimited, in the radial direction of the longitudinal axis Le of the held power tool 11, by the outer surface 33 of the inner element 31.

The delimitation recess 54 has an extent, along the plane E, that is less than an extent of the user interface unit 29 along the plane E.

The held power tool 11 has a sealing element 57, which is arranged between the user interface unit 29 and the machine housing 13. The sealing element 57 is realized as a labyrinth seal. The sealing element 57 may be formed from a plastic or a foam material. The sealing element 57 is designed to seal off a gap (not shown) between the machine housing 13 and the user interface unit 29, for example against dirt and water.

The user interface element 29 has a plurality of indicating element that are designed to indicate information, wherein, in one embodiment, three indicating element are designed to indicate a set rotational speed (FIG. 5*a*), and in further embodiments a further indicating element is designed to indicate a battery status of the battery unit (FIGS. 1, 2, 3*a*).

It is understood that the user interface unit 29 may also have an operating element that is realized as a single piece with the indicating element. For example, the operating element may be realized as an operating button that, upon actuation, indicates information concerning the actuated operating button, for example by illumination of the actuated operating button. The user interface unit 29 has three operating buttons. The operating buttons may be provided to.

What is claimed is:

1. A hand-held power tool, comprising:

a drive unit configured to transmit a motion to an output unit;

a machine housing that surrounds the drive unit in a first plane;

an inner element completely surrounded by the machine housing in a second plane; and a user interface unit configured to operate the hand-held power tool, and at least one of (i) positioned on the inner element, and (ii) connected to the inner element.

2. The hand-held power tool of claim 1, wherein:

the user interface unit is positioned on or connected to a flat outer surface of the inner element; and an inner surface of the inner element faces toward a cavity in which the drive unit is located.

3. The hand-held power tool of claim 1, wherein the inner element is one of (i) a motor housing of the drive unit, and (ii) an air guide element.

4. The hand-held power tool of claim 1, wherein the machine housing completely surrounds the user interface unit in at least one of the first plane and the second plane.

5. The hand-held power tool of claim 1, wherein:

an inner surface of the user interface unit faces toward a cavity in which the drive unit is located; and the machine housing overlaps the user interface unit such that portion of the machine housing is located directly outwardly of an outer surface of the user interface unit in a plane parallel to the second plane.

6. The hand-held power tool of claim 5, wherein the machine housing overlap is on a side facing away from the inner element.

7. The hand-held power tool of claim 1, wherein the user interface unit is materially bonded to the inner element.

8. The hand-held power tool of claim 7, wherein the user interface unit is materially bonded to the inner element via at least one of adhesive bonding, positive engagement, clamping, non-positive engagement, and tensioning.

9. The hand-held power tool of claim 1, wherein the user interface unit includes:

a first user interface element that includes a human-machine interface configured to actuate or indicate a function of the hand-held power tool; and a second user interface element that includes an actuating element configured to actuate the drive unit.

10. The hand-held power tool of claim 1, wherein the machine housing is formed from a shell construction, and includes a machine-housing shell.

11. The hand-held power tool of claim 1, wherein the machine housing is formed from a barrel construction, and includes a machine-housing barrel.

12. The hand-held power tool of claim 1, wherein the machine housing includes a delimitation recess configured to receive the user interface unit such that the user interface unit is viewable by a user through the delimitation recess.

13. The hand-held power tool of claim 12, wherein:

an outer surface of the inner element delimits the delimitation recess; and the user interface unit is positioned on the outer surface.

14. The hand-held power tool of claim 12, wherein:

an inner surface of the inner element faces toward a cavity in which the drive unit is located; and an outer surface of the inner element delimits the delimitation recess.

15. The hand-held power tool of claim 1, further comprising:

a sealing element positioned in a gap between the user interface unit and the machine housing and sealing the gap between the user interface unit and the machine housing.

16. The hand-held power tool of claim 1, wherein the first plane is orthogonal to the second plane.

* * * * *